US006199856B1

(12) United States Patent
Clauser et al.

(10) Patent No.: US 6,199,856 B1
(45) Date of Patent: Mar. 13, 2001

(54) FLEXIBLE MEDIA STACKING AND ACCUMULATING DEVICE

(76) Inventors: Robert Clauser, 3 Holly Dr., Columbus, NJ (US) 08022; David C. Deaville, 1 Bellbrook Dr., West Chester, PA (US) 19382; Andre Gerlier, Hameau de Prailles, F-74140 Sciez (FR); Thomas E. Shuren, 5 Brecknock Ter., West Chester, PA (US) 19380; Neil M. Young, 1502 Pamela Dr., Downingtown, PA (US) 19335

( * ) Notice: Subject to any disclaimer, the term of this patent is extended or adjusted under 35 U.S.C. 154(b) by 0 days.

(21) Appl. No.: 09/225,588

(22) Filed: Jan. 6, 1999

Related U.S. Application Data

(60) Provisional application No. 60/070,723, filed on Jan. 7, 1998.

(51) Int. Cl.[7] ..... B65H 29/44
(52) U.S. Cl. ..... 271/180
(58) Field of Search ..... 271/177, 180, 271/181, 207, 212, 220

(56) References Cited

U.S. PATENT DOCUMENTS

| | | | |
|---|---|---|---|
| 3,917,260 | 11/1975 | Okkonen et al. . | |
| 3,977,669 | 8/1976 | Douno . | |
| 4,000,892 | 1/1977 | Novak et al. . | |
| 4,011,931 | 3/1977 | Wyckoff . | |
| 4,037,703 | 7/1977 | Michaud et al. . | |
| 4,050,562 | 9/1977 | Schwippert et al. . | |
| 4,106,767 | 8/1978 | Schirrmeister et al. . | |
| 4,348,656 | 9/1982 | Gorgone et al. . | |
| 4,418,824 | 12/1983 | Gorgone et al. . | |
| 4,513,880 | 4/1985 | Mori et al. . | |
| 4,556,139 | 12/1985 | Akagawa et al. . | |
| 4,722,519 | 2/1988 | Zouzoulas . | |
| 4,731,523 | 3/1988 | Kozima . | |
| 4,784,274 | 11/1988 | Mori et al. . | |
| 4,807,736 | 2/1989 | Kondo et al. . | |
| 4,807,866 * | 2/1989 | Stemmle | 271/180 X |
| 4,809,966 | 3/1989 | Kobayashi et al. . | |
| 4,809,967 | 3/1989 | Kondo . | |
| 4,834,230 | 5/1989 | Kondo et al. . | |
| 4,844,446 | 7/1989 | Thie et al. . | |
| 4,905,839 | 3/1990 | Yuge et al. . | |
| 4,905,840 | 3/1990 | Yuge et al. . | |

(List continued on next page.)

FOREIGN PATENT DOCUMENTS

| | | |
|---|---|---|
| 90 05 298 | 8/1990 | (DE) . |
| 0 185 862 A2 | 7/1986 | (EP) . |
| 0 290 731 B1 | 11/1988 | (EP) . |
| 0 333 124 A2 | 9/1989 | (EP) . |
| 0 747 866 A1 | 12/1996 | (EP) . |
| 0 749 926 A1 | 12/1996 | (EP) . |
| 0 751 487 A1 | 1/1997 | (EP) . |
| 0 755 883 A1 | 1/1997 | (EP) . |
| 0 793 197 A2 | 9/1997 | (EP) . |
| 0 793 198 A2 | 9/1997 | (EP) . |
| 0 793 199 A2 | 9/1997 | (EP) . |
| 0 793 200 A2 | 9/1997 | (EP) . |
| 0 793 201 A2 | 9/1997 | (EP) . |
| 2 198 122 | 6/1988 | (GB) . |

*Primary Examiner*—David H. Bollinger
(74) *Attorney, Agent, or Firm*—Fish & Richardson P.C.

(57) ABSTRACT

A device and technique for storing flexible media of different dimensions is described. In an implementation, the device includes a carriage having at least two rotating members, a membrane wrapped about each rotating member, a frame and at least one actuator. When flexible media, such as a banknote, is fed into the device, the actuator causes the carriage to move in a forward direction so that a first membrane unwraps to press a banknote onto a stack. The carriage then moves in a reverse direction back into an initial position, and the first membrane wraps about a rotating member and a second membrane unwraps to hold the banknote in place.

33 Claims, 15 Drawing Sheets

U.S. PATENT DOCUMENTS

| | | |
|---|---|---|
| 5,013,026 | 5/1991 | Howell . |
| 5,014,857 | 5/1991 | Kondo . |
| 5,020,110 | 5/1991 | Chominski . |
| 5,116,037 | 5/1992 | Gerlier et al. . |
| 5,161,736 | 11/1992 | Roccoberton et al. . |
| 5,205,481 | 4/1993 | Dekker . |
| 5,254,841 | 10/1993 | Watabe et al. . |
| 5,314,177 | 5/1994 | Anma . |
| 5,322,275 | 6/1994 | Gardellini et al. . |
| 5,344,135 | 9/1994 | Isobe et al. . |
| 5,388,817 | 2/1995 | Chang . |
| 5,419,423 | 5/1995 | Ishida et al. . |
| 5,421,443 | 6/1995 | Hatamachi et al. . |
| 5,533,605 | 7/1996 | Mays et al. . |
| 5,564,545 | 10/1996 | Suzuki . |
| 5,564,691 | 10/1996 | Hatamachi et al. . |
| 5,624,017 | 4/1997 | Plesko . |
| 5,639,081 | 6/1997 | Hatamachi et al. . |
| 5,641,157 | 6/1997 | Mays et al. . |
| 5,662,202 | 9/1997 | Suris . |

* cited by examiner

FLEXIBLE MEDIA STACKING AND ACCUMULATING DEVICE

This application claims benefit to Provisional Application No. 60/070,723 filed Jan. 7, 1998.

BACKGROUND OF THE INVENTION

The present invention relates to a mechanism for stacking flexible media of varying dimensions and accumulating the stacked material. In particular, an embodiment of the mechanism operates to stack banknotes of different dimensions in a storage cassette.

Banknote acceptors are well known and have found wide applications in vending, ticketing and gaming applications. Such acceptors generally have a facility for storing the accepted banknotes in an orderly fashion. This facilitates bulk handling of the accepted money and is an efficient use of the limited space available in a typical automatic transaction machine installation.

In sophisticated automatic transaction machine applications, such as in casino gaming machines, the currency is stacked in an enclosed, lockable removable cassette. In such applications the money cannot be directly accessed by the operator servicing the host machine. Instead, the money is transported in the locked cassette to a secure place, such as a central cash handling room, where an authorized person opens the cassette.

The vast majority of currency stacker units in production today use a stacking technique involving transporting a bill in a bill passageway or elevator to a location opposite a pressure plate or ram mechanism. The pressure plate is typically oriented to be perpendicular to the surface of the bill and is operated to drive the money out of the channel and into the storage compartment. For example, U.S. Pat. No. 3,917,260 to Okkonen et al. and U.S. Pat. No. 4,722,519 to Zouzoulas describe such devices.

Alternative stacking mechanisms include a bill channel comprised of longitudinal members which rotate (see U.S. Pat. Nos. 5,639,081, 5,564,691 and 5,624,017). None of these devices is well adapted to applications where the flexible media may be of variable size and shape, and where the stacker mechanism must be implemented in a compact physical space.

SUMMARY OF THE INVENTION

An apparatus capable of storing flexible media of a plurality of dimensions is provided. The device includes a carriage having at least two rotating members, wherein a membrane is wrapped about each of the rotating members, a frame for supporting the membranes, and at least one actuator. The actuator causes a first membrane to unwrap and a second membrane to wrap about their respective rotating members as the carriage moves.

The device may include one or more of the following features. The device may include a container connected to the frame. A pressure plate may be connected to the container, wherein the pressure plate exerts a force against the unwrapped portion of the membranes. A biasing means may be connected to the pressure plate to distribute the force. The device may also include a diverter connected to the carriage to guide the flexible media. In addition, a nip roller may be connected to the carriage for gripping the flexible media. An elastic element may be included to bias the nip roller into a gripping position, and a ramp and cam mechanism may be included to bias the nip roller into a gripping position. The ramp and cam mechanism may bias a diverter into a position to guide the flexible media. The device may include at least one actuator coupled to at least one rotating member, and/or at least one actuator coupled to the carriage. A bill validator for transporting bills to the carriage may be included. At least one additional actuator may be included, wherein at least one additional actuator may move a diverter that is connected to the carriage. In addition, at least one additional actuator may be included to move a nip roller that is connected to the carriage. At least one rotating member may comprise a rotatable shaft mounted in the frame and an intermediate element mounted in the carriage for supporting the membrane. The membranes may be spring coils, and/or the membranes may comprise a plurality of strips. A sheath may be included for controlling the strips. At least one torsional elastic element may supply a tension to at least one of the membranes.

Another aspect of the invention concerns a method for a stacker apparatus capable of stacking flexible media of varying dimensions in any of a plurality of orientations. The method includes transporting the flexible media to a carriage; translating the carriage to unwrap a first membrane from a first rotating member and to fold the leading edge of the media onto a stack; wrapping a second membrane about a second rotating member of the carriage; gripping the media between the first membrane and the stack as the carriage moves to stack the media; translating the carriage in the opposite direction after the media has been stacked; and gripping the media between the second membrane and the stack as the second membrane unwraps from the second rotating member.

The method may include one or more of the following features. A plurality of sheets of flexible media may be stacked during a stacking cycle. The carriage may move in a linear path to stack flexible media. Alternately, the carriage may move in a curved path.

In an alternate implementation, an apparatus capable of stacking flexible media of a plurality of dimensions is provided. The apparatus includes a container for storing the flexible media. A carriage movably mounted on the container has at least two rotating members, and a membrane is wrapped about each of the rotating members.

The apparatus may include one or more of the following features. At least one actuator may be included for driving the carriage. At least one actuator may be coupled to at least one of the rotating members, and/or at least one actuator may be coupled to the carriage. A pressure plate may be attached to the container for exerting a force against the unwrapped portion of the membranes. Biasing means may be connected to the pressure plate to distribute the force. The carriage may include a nip roller for gripping the flexible media as it is inserted. The carriage may include a diverter for guiding the flexible media. A bill validator may be included for transporting bills to the carriage. At least one rotating member may include a rotatable shaft and an intermediate element for supporting the membrane.

The invention advantageously provides a means for stacking flexible media (for example, banknotes, coupons, bank drafts, traveller's cheques, and the like) and accumulating the flexible media in a container. The device safely and dependably handles flexible media of variable sizes and shapes. The invention is simple and compact and offers highly reliable handling of sheets that may be torn, wet or otherwise in poor physical condition.

The details of one or more embodiments of the invention are set forth in the accompanying drawings and the description below. Other features, objects and advantages of the invention will be apparent from the description and drawings, and from the claims.

BRIEF DESCRIPTION OF THE DRAWINGS

Like reference numbers and designations in the various drawings indicate like elements.

DETAILED DESCRIPTION

Figure 1:
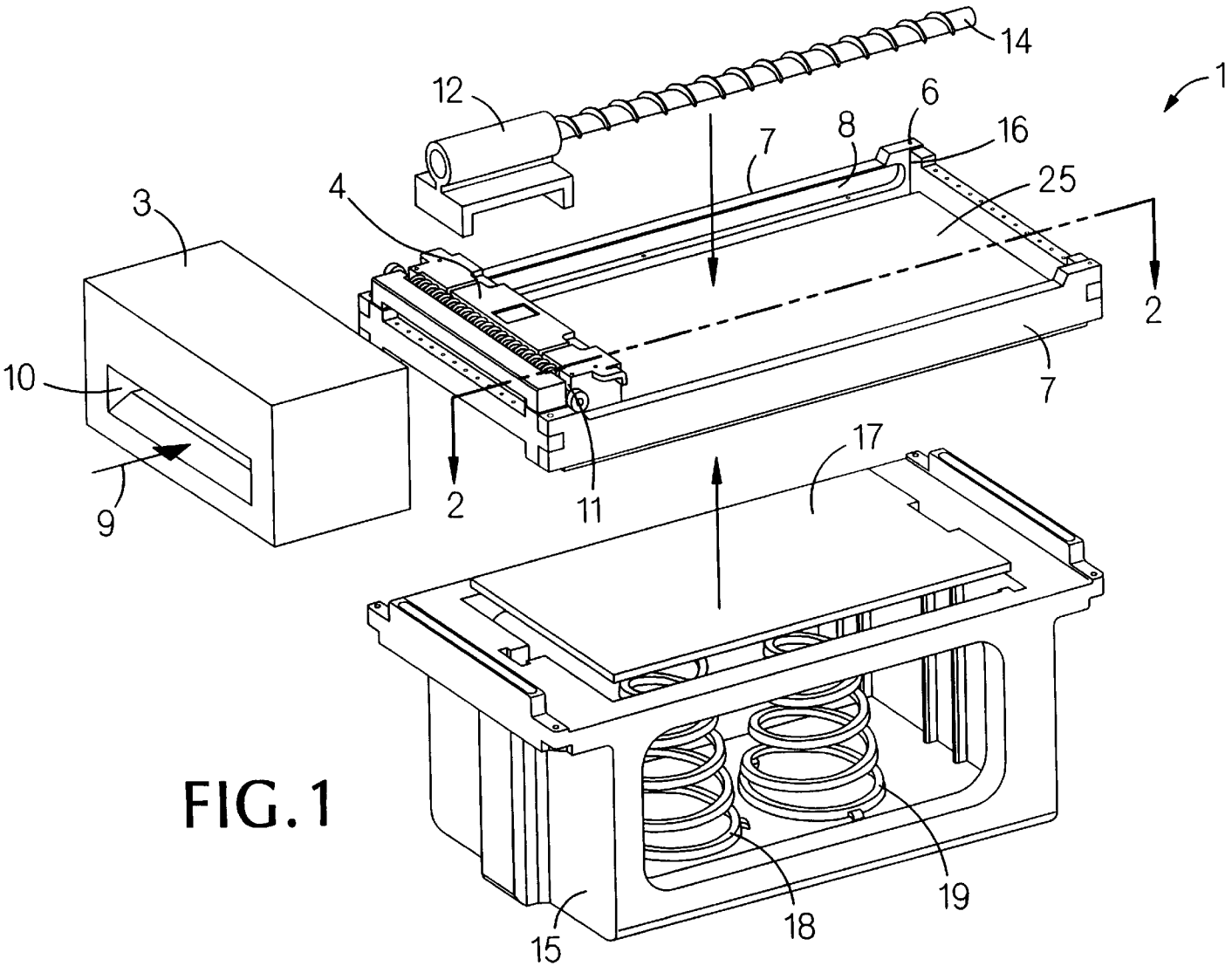
FIG. 1 is an exploded perspective view of a mechanism according to the invention.

Various embodiments of the present invention will be described by way of example with reference to the drawings, which are not necessarily drawn to scale. FIG. 1 is an exploded perspective view of the stacking mechanism 1. The orientation shown is for ease of understanding, and it should be understood that gravity plays no part in the operation of this mechanism. In particular, the device 1 may operate to grip a flexible media sheet and stack it without using the force of gravity. Thus, the mechanism 1 will function equally well in any orientation.

The device 1 may be attached to, or be part of, a container 15 that may be of a secure cassette design capable of being transported separate from the host machine. In one embodiment, the contents of the container are only accessible to key holders or similarly authorized people. The apparatus is typically used in conjunction with an automatic currency processing device, for example a U.S. paper currency acceptor 3. Such devices are widely used in vending, ticketing, gaming and like applications. However, it should be understood that the device 1 could be employed for use with any flexible media, for example plastic currency, security documents, commercial paper, paper coupons and the like.

The simplified drawing of a banknote acceptor 3 in FIG. 1 feeds bills directly into the stacker mechanism 1. The subjects of banknote sensing, recognition and validation are beyond the scope of this invention, as is the subject of bill transport, and will not be discussed in detail herein. It is noted, however, that if the recognition and sensing element for the flexible media, such as the banknote validator 3 shown in FIG. 1, is made sufficiently short, it may be possible to build a complete validator with no additional bill transport system. For example, in the configuration shown in FIG. 1, the user feeds a bill into entryway 10 in the direction of arrow 9 where it is validated and transported directly into the stacker mechanism by the banknote acceptor 3. Such a configuration results in significant advantages in compactness, reliability, durability, and manufacturing cost.

The banknote acceptor 3 typically includes a control means (not shown), such as a microprocessor, and related sensors. At least one sensor indicates the distance that the bill has been driven into the stacker mechanism 1 and generates a signal to trigger a linear actuator (not shown) to perform the stacking function. Many methods of generating linear motion from an electrical input are known, for example using a motor connected to a leadscrew 14.

As shown in FIG. 1, the stacker mechanism 1 includes a traveling carriage 4 which moves in a frame 6. The frame 6 has opposite sides 7 having tracks formed by grooves 8 in which the carriage 4 moves. The carriage 4 is coupled to an actuator (not shown) via a clamp 12 and leadscrew 14 which drives the carriage in its tracks. Alternately, as explained below, the carriage may contain at least one motor for propelling the carriage. The grooves or tracks in the frame are arranged in two planes so that the carriage has only freedom of movement in one axis. The carriage is approximately fixed in the other five axes, so that the carriage is prevented from pitching, rolling or yawing. Details of suitable linear slide arrangements are well known and are not described in detail here.

The sides 7, front end 11 and rear end 16 of the frame 6 could suitably be extended to form the walls of a cashbox 15. However, the frame 6 could be separate from the cashbox and be of other sizes, and could be designed to connect to cashboxes having walls of different dimensions.

Inside the cashbox 15 is a spring loaded pressure plate 17 which, in its rest position, exerts a small force against the traversing carriage 4 and a membrane 25 shown in FIG. 1, which is explained in further detail below. It is desirable to guide the pressure plate so that its motion is always perpendicular to the bill and to ensure that negligible lateral movement, pitch, roll or yaw is permitted. Such operation is required if a great range of bill sizes is to be accommodated and the number of bills to be stacked is also large. Therefore, in the configuration shown in FIG. 1, two springs 18, 19 are connected to the pressure plate to evenly distribute an upward force. Further, the pressure plate 17 may travel in tracks (not shown) to control pitch and/or roll. The cashbox itself may otherwise be of conventional construction familiar to those skilled in the art and is not further described in detail. Further, the carriage could be designed to travel across the top of a cashbox without use of a frame or tracks.

Figure 2:
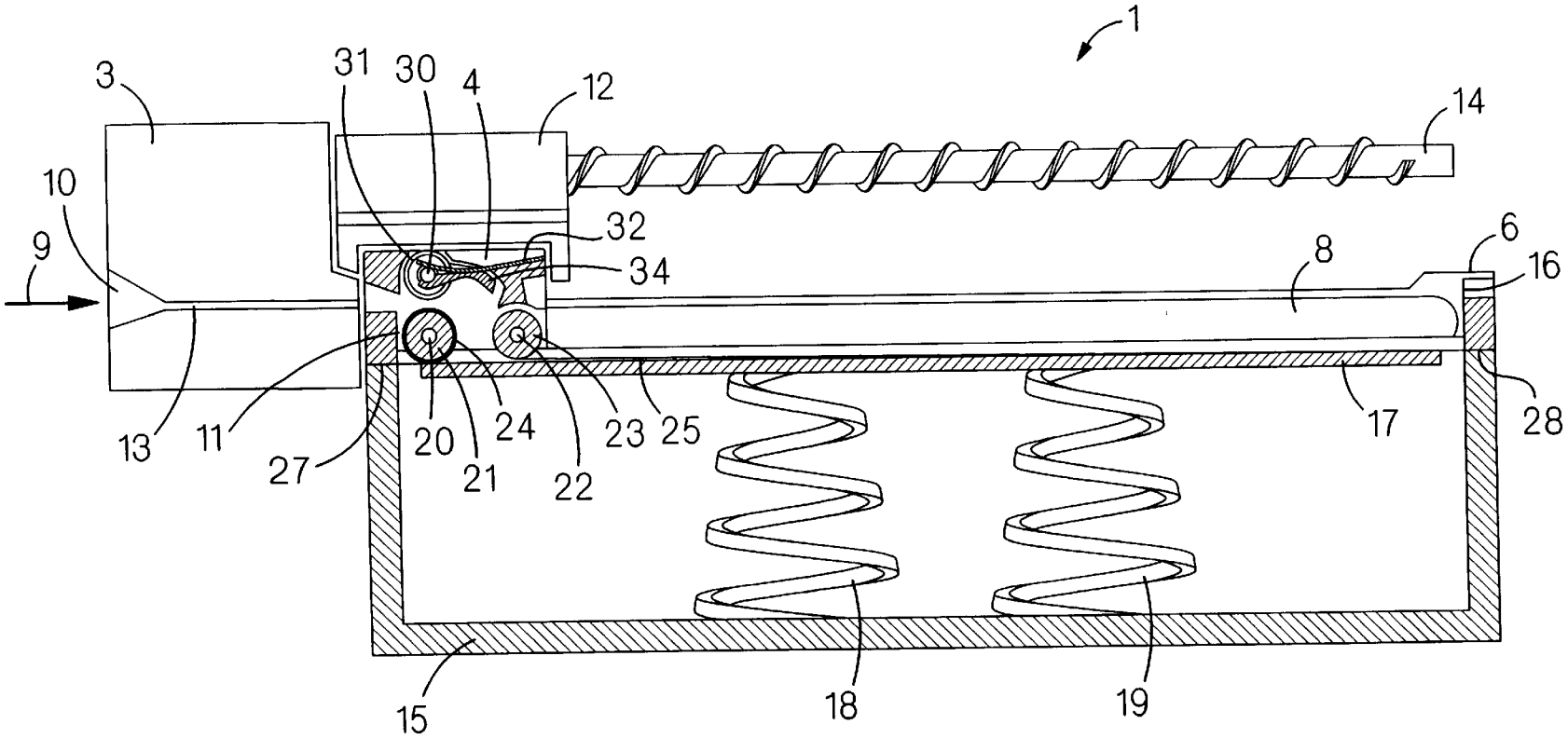
FIG. 2 is a cross sectional view of the mechanism along dotted line 2—2 of FIG. 1.

FIG. 2 is a cross-sectional view along dotted line 2—2 of FIG. 1 of the mechanism, to illustrate certain aspects of the device. As in FIG. 1, details of bill validator 3 and storage cassette 15 are omitted for brevity and clarity. The validator 3 contains a bill passageway 13 for guiding the bill to the carriage 4. The cross sectional view shows the internal mechanism of the carriage 4 which includes a pair of parallel shafts 20, 22 which can freely rotate in bearings. Installed on these shafts 20, 22 are one or more hollow cylinders 21, 23. In the case of multiple hollow cylinders, each should have the freedom to rotate independently of each other. In the embodiment shown, each hollow cylinder has one constant force coil spring membrane 24, 25 wrapped around it. In FIGS. 1 and 2, the coil spring membrane 25 is shown in its extended position, while the coil spring membrane 24 is shown wrapped about hollow cylinder 21. The coil springs are conveniently retained by friction about the cylinders arising from making the hollow cylinders slightly larger than the unloaded internal diameter of the springs. One end of each constant force spring membrane is anchored at locations 27, 28 at the front end 11 and rear end 16 of the fixed frame 6.

The pressures exerted by the coil spring membranes 24, 25 are in balance due to the symmetrical nature of the design. Therefore, quite small forces are required to move the carriage 4 in the rails in either direction. In addition, the coil spring membranes shown in FIGS. 1 and 2 may be suitably made of one piece of metal or like material wound up into a tight coil, such as the metal used in a compact metal tape measure. Such coil spring membranes may be tamper-resistant or tamper evident, thus improving security.

Referring again to FIG. 2, adjacent to one of the shafts 20, 22 is a third parallel shaft 30 which supports a nip-roller 31. This shaft 30 can move in a radial slot. A pair of leaf springs, one on each end of shaft 30 (one leaf spring 32 is shown in FIG. 2), provide constant pressure to this roller. Thus, variations in flexible media thickness and variations in the mating roller diameter are accommodated while applying an approximately constant contact force.

A diverter blade 34 is also pivotally mounted on the nip roller shaft 30. The diverter blade is normally in a position as shown that is almost perpendicular to the direction of bill travel, shown as arrow 9, as a bill moves through the validator 3. The diverter blade operates to force an item being stacked to conform approximately to the lower surface of the coil spring membrane 24 of mating roller 21. (This surface is preferably formed by the unwinding of the coil springs).

A cam mechanism is also provided so that at the extreme end of carriage travel, at front end 11, the diverter is forced to assume a more nearly horizontal position, as depicted in FIG. 2. In this position, the diverter 34 presents negligible resistance to the arrival of a new bill. At other times a bias spring 35 (shown in FIG. 3) presses the diverter to its alternative vertical orientation, which is discussed below with reference to FIGS. 5 to 7.

Figure 3:
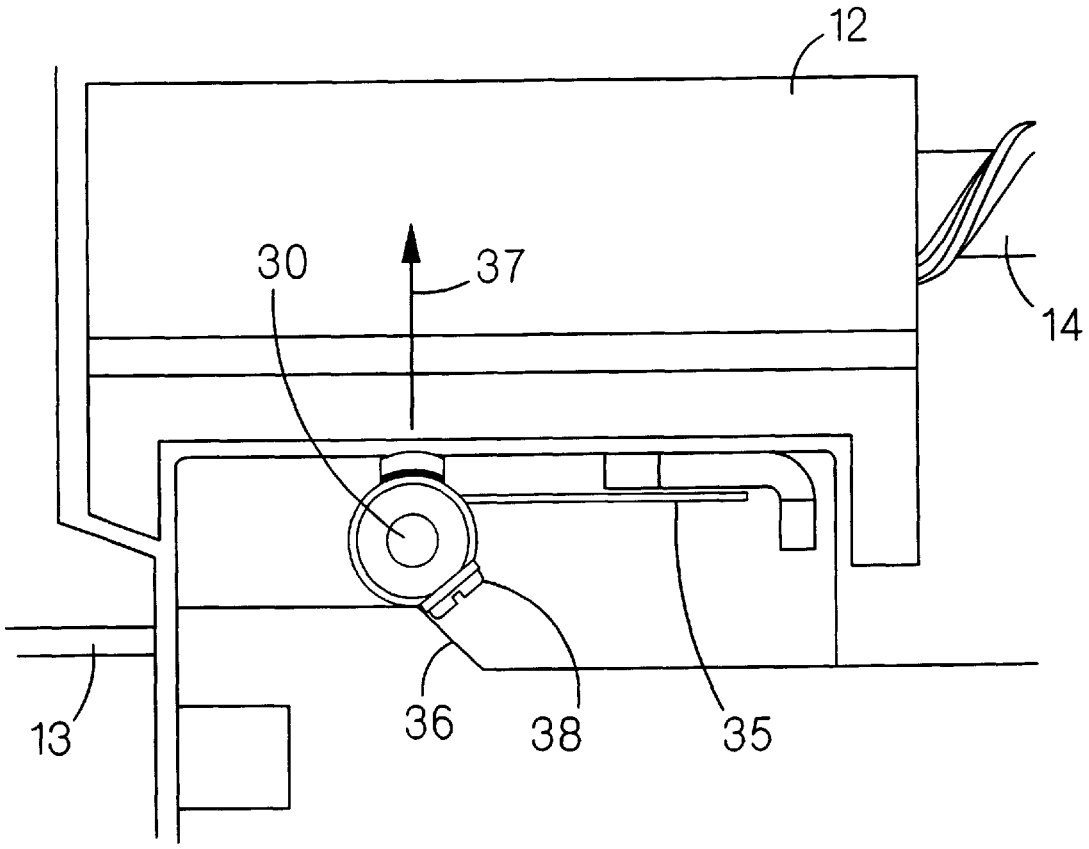
FIG. 3 is a detail, cutaway side view showing the ramp and cam mechanism of FIG. 2 for articulating the nip roller and diverter flap motions.

FIG. 3 is a detailed cutaway side view of the nip roller shaft 30 of FIG. 2 showing a ramp 36 that conveniently forms a cam surface for a screwhead 38 for articulating the nip roller 31 and diverter flap 34 motions. In particular, when the carriage 4 is in its left-most position as shown in FIG. 2, then the screw 38 is in contact with the ramp surface 36 formed in the front end 11 of the frame 6. This orientation forces a deflection of the torsion spring 35, as shown, which translates into the diverter blade 34 being in the nearly horizontal position shown in FIG. 2. The ramp 36 also forces the nip roller shaft 30 to be translated in the direction of arrow 37 to articulate the nip roller 31 away from hollow cylinder 21 and coil spring membrane 24 (as shown in FIG. 2) so that an inserted flexible sheet can pass between them. As described below, when the carriage 4 is moved away from the front end 11, then the nip roller 31 moves in a direction opposite the direction of arrow 37 to clamp the bill between it and the membrane 24, and diverter blade 34 assumes an orientation that is nearly vertical (see FIGS. 4 to 7) to guide the flexible sheet into the cassette 15 for storage.

Figure 3A:
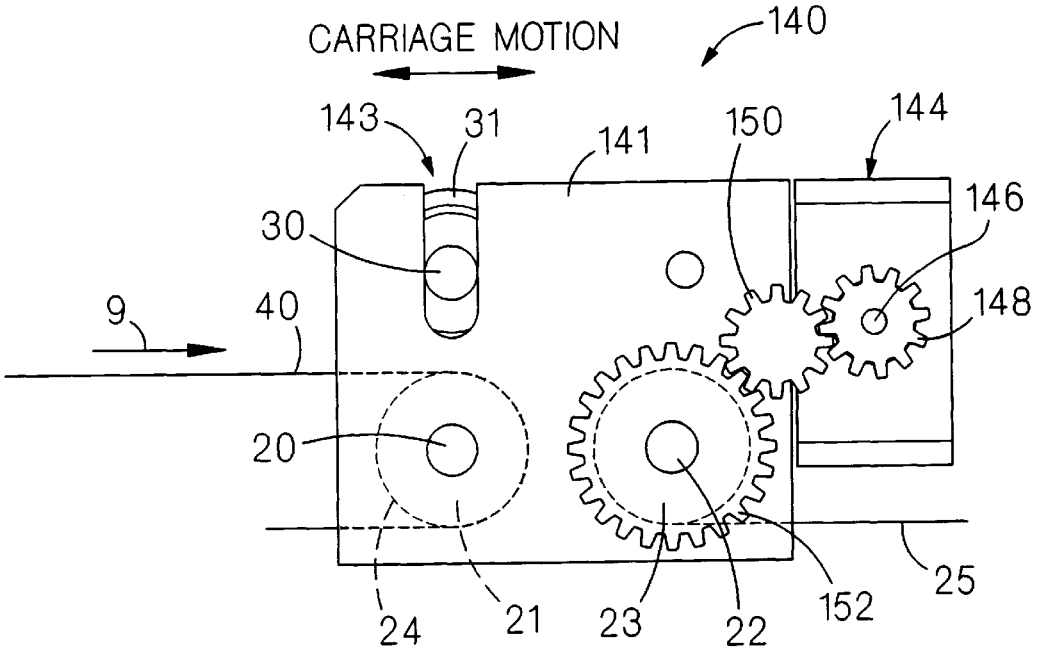
FIG. 3A is a side view of a motorized carriage for use in a mechanism according to the invention.

FIG. 3A is a side view of an alternate implementation of a carriage 140 for use in a device according to the invention. The carriage 140 contains a reversible motor for propelling the carriage back and forth, and could replace the traveling carriage 4 shown in FIGS. 2 and 3. The motorized carriage 140 includes a carriage housing 141 having a slot 143 for guiding shaft 30 of nip roller 31. The motorized carriage 140 also includes a pair of parallel shafts 20, 22 upon which are mounted one or more hollow cylinders 21, 23, shown in dotted lines because they are located behind the housing 141. The hollow cylinders of these rotatable members are arranged in a manner similar to that discussed above in relation to the carriage 4. Each hollow cylinder may include at least one constant force coil spring membrane 24, 25 wrapped about it. In FIG. 3A, the coil spring membrane 25 is shown in an extended position, while most of the coil spring membrane 24 is wrapped about hollow cylinder 21. Also shown in FIG. 3A is a bill 40 which is wrapped about the cylinder 21 and is in position to be stacked. The arrow 9 indicates flexible sheet or bill motion as the sheet exits a validation section and contacts the hollow cylinder 21 and nip roller 31, which operation will be described in more detail below.

The motor (not shown) is contained within motor housing 144 and operates to drive a shaft 146 connected to drive gear 148. The drive gear 148 meshes with a coupling gear 150 that in turn meshes with a traverse gear 152 connected to the hollow cylinder 23. Consequently, the cylinder 23 is driven through a direct gear train by the motor which provides torque to the roller to cause the spring membrane 25 to coil about or wrap around the hollow cylinder 23 and thus to impart motion to the carriage.

At rest, the pressures exerted by the coil spring membranes are substantially in balance due to the symmetrical nature of the design. The coil springs thus counterbalance each other. Consequently, only a small force is required to move the carriage 140 via the gearing arrangement. Thus, a small reversible DC motor such as, for example, a miniature permanent magnet DC motor, or other low-power actuator would be adequate to impart movement.

Figure 3B:
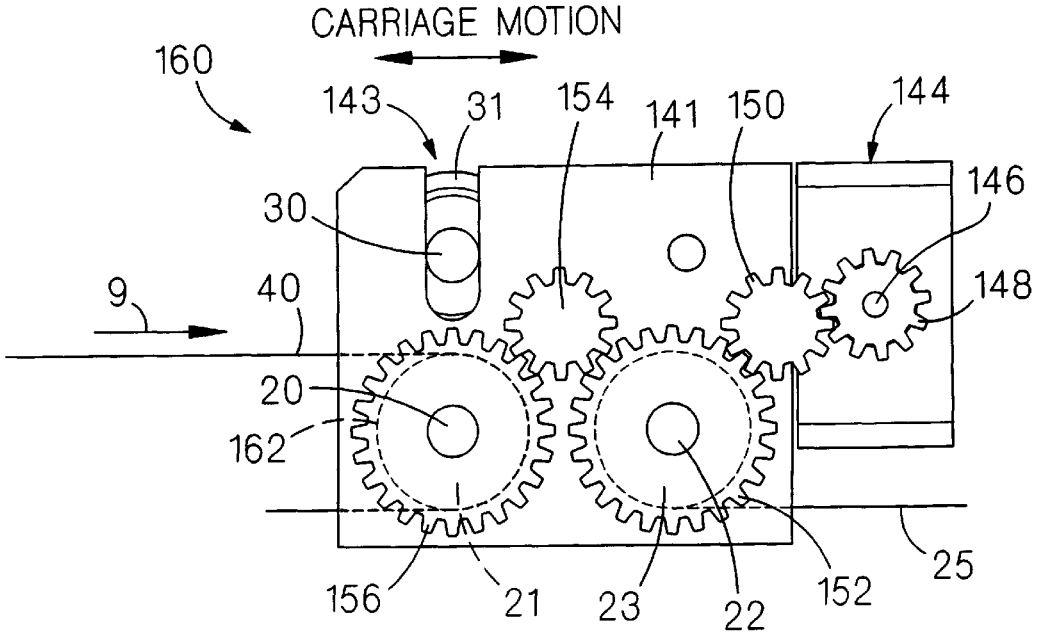
FIG. 3B is a side view of another implementation of a motorized carriage for use in a mechanism according to the invention.

FIG. 3B is a side view of an alternate implementation of a carriage 160 for use in a device according to the invention, wherein like elements of FIG. 3A have the same reference numbers. The carriage 160 contains a reversible motor for propelling the carriage back and forth along a path, and includes a carriage housing 141 having a slot 143 for guiding shaft 30 of nip roller 31. The motorized carriage 160 also includes a pair of parallel shafts 20, 22 upon which are mounted one or more hollow cylinders 21, 23, shown in dotted lines because they are located within the housing 141. These rotatable members are arranged in a manner similar to that discussed above. The motor (not shown) is contained within motor housing 144 and operates to drive a shaft 146 connected to drive gear 148. The drive gear 148 meshes with a first coupling gear 150 that in turn meshes with a first traverse gear 152 connected to the hollow cylinder 23. The first traverse gear 152 meshes with a second coupling gear 154, which meshes with a second traverse gear 156 connected to the hollow cylinder 21. Consequently, both of the hollow cylinders 21 and 23 are driven through a direct gear train by the motor.

In FIG. 3B, a coil spring membrane 25 is shown in an extended position, while most of the membrane 162 is wrapped about hollow cylinder 21. In this implementation, only one coil spring membrane wrapped about a hollow cylinder is required since the motor is directly linked to both hollow cylinders and can impart tension on the membrane that does not contain a coil spring. In particular, in the implementation shown, the motor can provide tension to the membrane 162 as it unwraps from the hollow cylinder 21 while a bill 40 is being stacked. However, a somewhat larger force may be required to move the carriage 160 via the gearing arrangement than needed to move the carriage 140 of FIG. 3A. But the carriage 160 contains one less coil spring, and a relatively small reversible DC motor or actuator could still be used to impart movement.

In an alternate embodiment, not shown, two or more motors may be used to transport the carriage back and forth along a path, and to perform other operations. In a contemplated implementation, one motor could be associated with each rotating member such that the rotating members would be driven independently of each other. The motor drive voltages could be set so that the membranes are in tension during carriage motion, and the two motors may be attached to the carriage on opposite sides. In such a two motor implementation the coil springs are not be required if the membranes 24 and 25 are kept under tension when not under drive, to ensure that the bills already stacked are securely held in the cashbox. In addition or alternately, the second actuator may be used to bias the nip roller into a gripping position and/or to move a diverter into a guide position.

An example to illustrate the sequence of events that occurs after a banknote has been accepted and then is stacked, referred to as a bill stacking cycle, will now be described.

Figure 4:
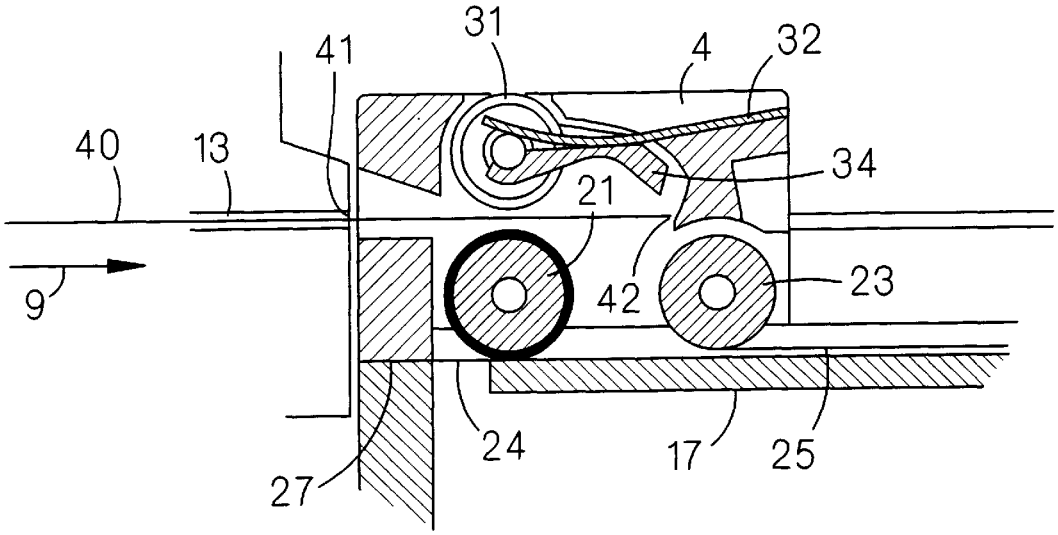
FIG. 4 is an enlarged, detail view of the cross section in FIG. 2 at the instant before the carriage traverse commences.

FIG. 4 is an enlarged, detail view of the cross section of FIG. 2 immediately before carriage traverse commences. A bill 40 has been inserted into the validator 3 and has been validated. The bill is then passed in the direction of arrow 9 through an exit slot 41 to the stacker mechanism. The leading edge 42 of the bill enters between the nip-roller 31 and the closest hollow cylinder 21, as shown in FIG. 4. As described above, the cam mechanism shown in FIG. 3 has caused the nip roller 31 to be lifted clear of the hollow cylinder 21 and spring coil membrane 24, and the diverter blade 34 to be rotated into a nearly horizontal position. At the instant the leading edge 42 of the bill arrives at the position indicated in FIG. 4, a carriage control signal is generated, for example, by a positional input from a tachometer wheel (not shown). The control signal causes the linear actuator (not shown) to move the carriage 4 at a rate the same as, or slightly faster than, the speed of bill transport. Alternately, if a motorized carriage 140 is used, the control signals would cause at least one motor in the carriage 140 to be energized and to thus drive the carriage. Such control signals may be generated by a processing means in the bill validator or otherwise generated by a control means of the automatic transaction machine, as will be readily understood by one skilled in the art. After a short distance, the carriage arrives at the position shown in FIG. 5.

Figure 5:
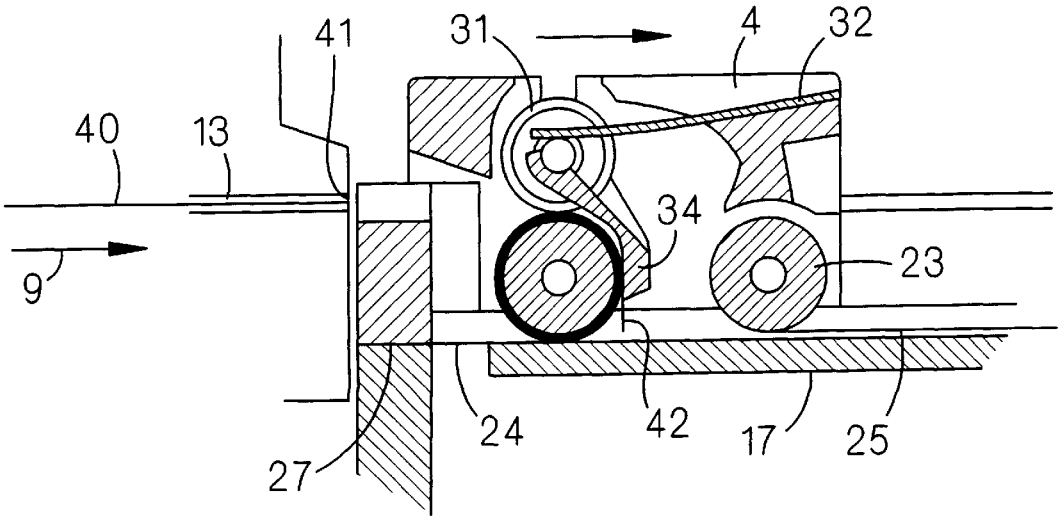
FIG. 5 is the same carriage detail as FIG. 4 after a short length of traverse during which time the nip roller is engaged and the bill folded around the first roller.

At the position shown in FIG. 5, the carriage moves away from the front end 11 and the screw cam 38 disengages from the ramp 36. With the ramp disengaged, the nip roller 31 drops down under the influence of leaf spring 32 into contact with the spring coil membrane 24 wrapped about cylinder 21, and a frictional connection is made with the bill. As the carriage 4 moves along the tracks, a driving force is imparted on the bill as the coil membrane 24 unwraps from cylinder 21. It can thus be understood that a membrane 24 with good frictional properties is desirable. This may be achieved by choice of material, secondary coatings and surface texture, or any combination of the above. In addition, in FIG. 5 the diverter blade 34 has rotated to a nearly vertical position under the influence of the torsion spring 35 shown in FIG. 3. As the carriage 4 (or carriage 140) progresses, the leading edge 42 of the bill moves downward approximately vertically until it touches either the pressure plate 17 or the face of a previously stacked bill. When this occurs, the unsupported leading edge 42 of the bill will begin to fold, and the motion of the carriage 4 in the direction of arrow 9 ensures that the bill will wrap around the spring coil membrane 24. As the carriage traverses further along down the tracks and the membrane 24 around the cylinder 21 unrolls further as shown in FIG. 6, the bill becomes pressed into the bill cassette 15 by a smooth rolling motion.

Figure 6:
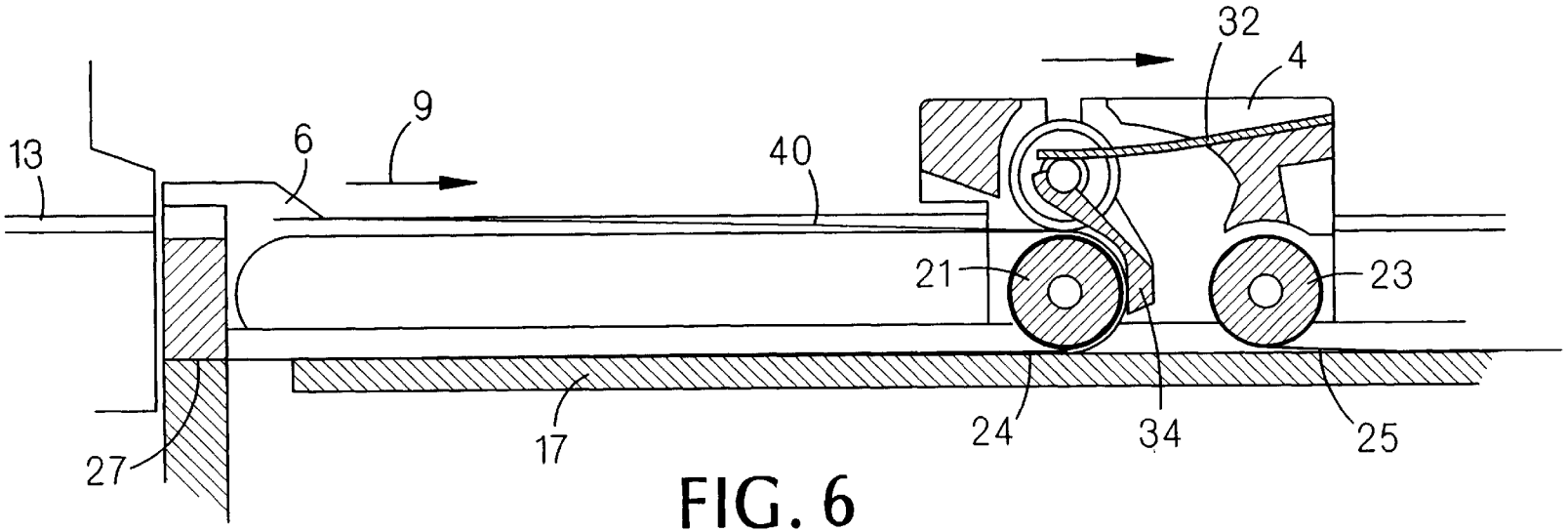
FIG. 6 is a similar detail section of FIGS. 4 and 5 around the midpoint of the carriage traverse.

FIG. 6 shows a cross section view at the midpoint of the carriage 4 between the front end and rear end of the frame 6. It should be noted that at any time after this point the bill validator transport motor may cease to drive because by this time the trailing edge of the bill has already passed through the validation section. Therefore, from this point onward the motion of the bill is generated by the friction between the bill 40 and the coil spring membrane 24 augmented by the friction of the bill 40 against the pressure plate 17 or previously stacked bills, as the carriage 4 continues to move. The pressure of the nip roller 31 caused by spring 32 in one direction, and the pressure from springs 18, 19 (shown in FIGS. 1 and 2) of the pressure plate 17 provides the perpendicular forces to generate this friction.

It should be noted that, as the membrane 24 is unrolled, the coil spring membrane 25 is being rolled up on hollow cylinder 23, and both actions are occurring at exactly the same rate as the carriage movement. There is therefore no relative motion between the surface of either coil spring membrane 24, 25 and any bill, either already stacked or in transit into the cassette.

Figure 7:
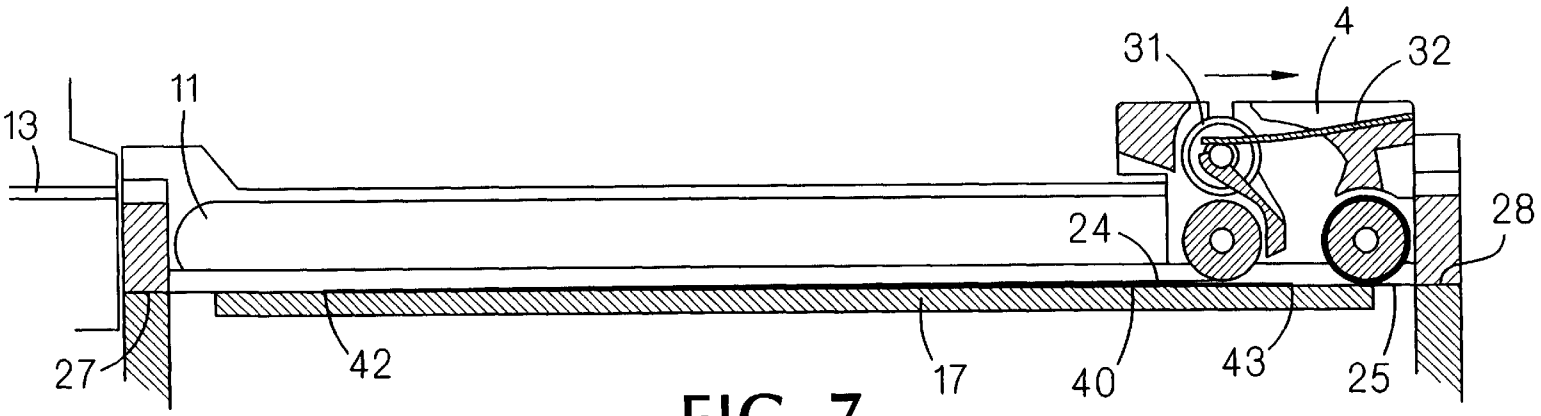
FIG. 7 shows the carriage section of FIG. 6 at the end of its travel with the bill stacked.

As shown in FIG. 7, at the full end of the traverse of the carriage 4, the trailing edge 43 of the bill 40 is released from the nip roller 31 and diverter 34, and eventually smoothly rolled into the stack. At this point, the controller responding to a carriage position sensor (not shown) sends a signal to the linear actuator to reverse the carriage motion. The carriage then moves back to the original start position towards front end 11 until it is in the position shown in FIG. 4. In so doing, the newly stacked bill is transferred under the spring coil membrane 25 as it unwraps from cylinder 23, again without any sliding friction against either of the membranes. The stacker mechanism is now ready to repeat the stacking cycle for another sheet of flexible media, which could be of a different dimension than the bill just stacked.

In order to move the carriage 4 back to the start position, the actuator may be reversed or a mechanical reversing drive element may be used. For example, a leadscrew with the groove arranged in the form of an elongated figure eight could be used. Alternately, if a motorized carriage 140 is used, then a control signal would cause the motor to reverse to propel the carriage in the opposite direction. In a two motor carriage implementation, the control signal may cause the first motor to turn OFF and a second motor to turn ON to drive the carriage in the reverse direction.

In the implementation of FIGS. 4 to 7, a ramp and cam mechanism is described which causes the nip roller 31 and diverter blade 34 to contact a bill when the carriage moves away from a front wall. However, other control devices could be used to control the operation of the nip roller and/or the diverter blade when the carriage is in the same position or in other positions in the path. For example, a microcontroller may generate signals to control an actuator to deploy the nip roller and/or diverter blade, or another type of electro-mechanical or other device could be used to control one or both of the nip roller and diverter blade.

Figure 8:
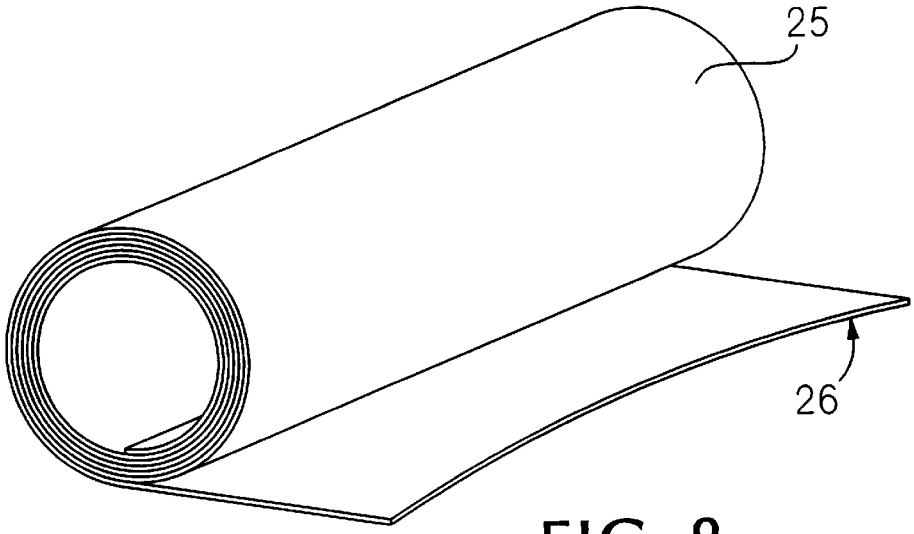
FIG. 8 is an embodiment of a spring coil membrane construction.

FIG. 8 is an example of a spring coil membrane 25 of the type that could be used in a carriage mechanism 4 or 140. The spring coil membrane 25 may be a one-piece metal member that can be rolled-up into a cylindrical shape as shown. The transverse camber 26 of the spring coil member is a byproduct of the forming process of the coil, and gives the membrane longitudinal stiffness to apply a constant clamping force to a flexible media, such as a bill 40, as it is rolled onto a stack or onto a pressure plate.

Figure 9:
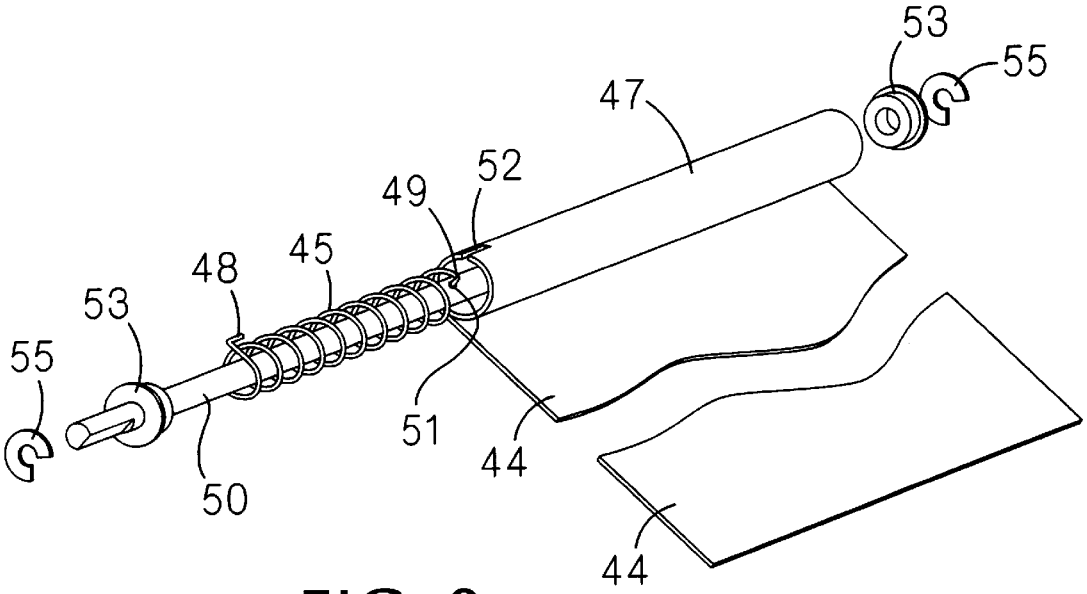
FIG. 9 is an exploded view of an alternative membrane tensioning scheme using an internal spring inside a hollow cylinder.

FIG. 9 is an exploded view of an alternative tensioning action on a membrane 44. In FIG. 9, the two properties of flexibility and tensioning are separated by incorporating a membrane spring 45 internal to a hollow cylinder 47. The spring 45 may be made of music wire or stainless steel using standard equipment. One end 49 of the spring is anchored to a fixed central shaft 50, for example, using a cross drilled hole 51. The other end 48 is attached to the hollow outer cylinder via a slot 52. The hollow outer cylinder 47 is supported by bearings 53 at either end and is free to rotate on the central shaft but is otherwise constrained in the axial plane by "C" rings 55 or equivalent means. In this embodiment, the membrane material 44 is relieved of any spring function. Therefore, the constitution of the membrane 44 may be optimized for strength, flexibility, friction properties and durability. Suitable materials may include plastics, woven fabrics, metal films, or composite materials with a tough, non-stretch substrate coated with a friction material.

Figure 10:
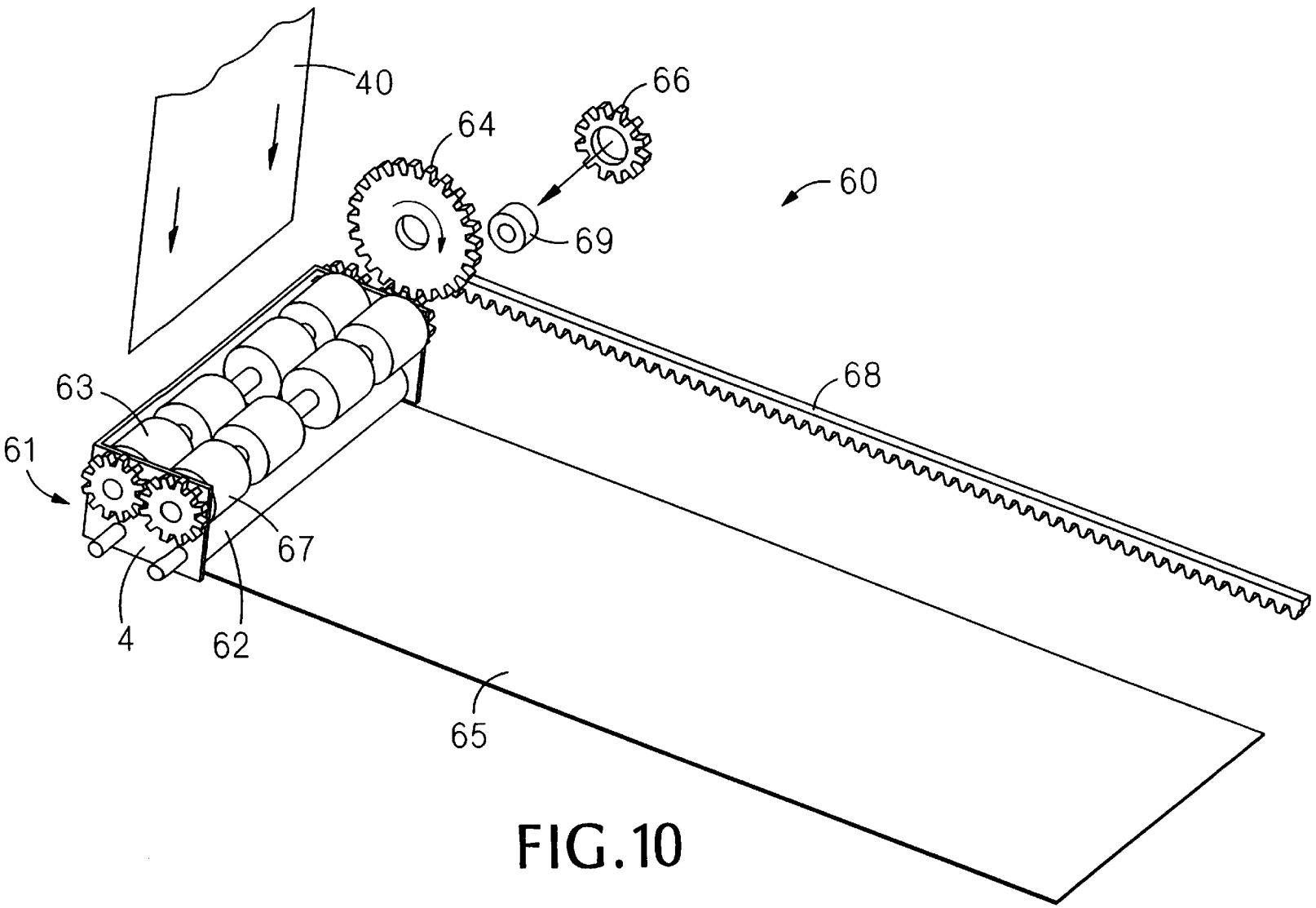
FIG. 10 is a partially exploded view of an alternative bill drive system using a gear and rack mechanism.
Figure 11:
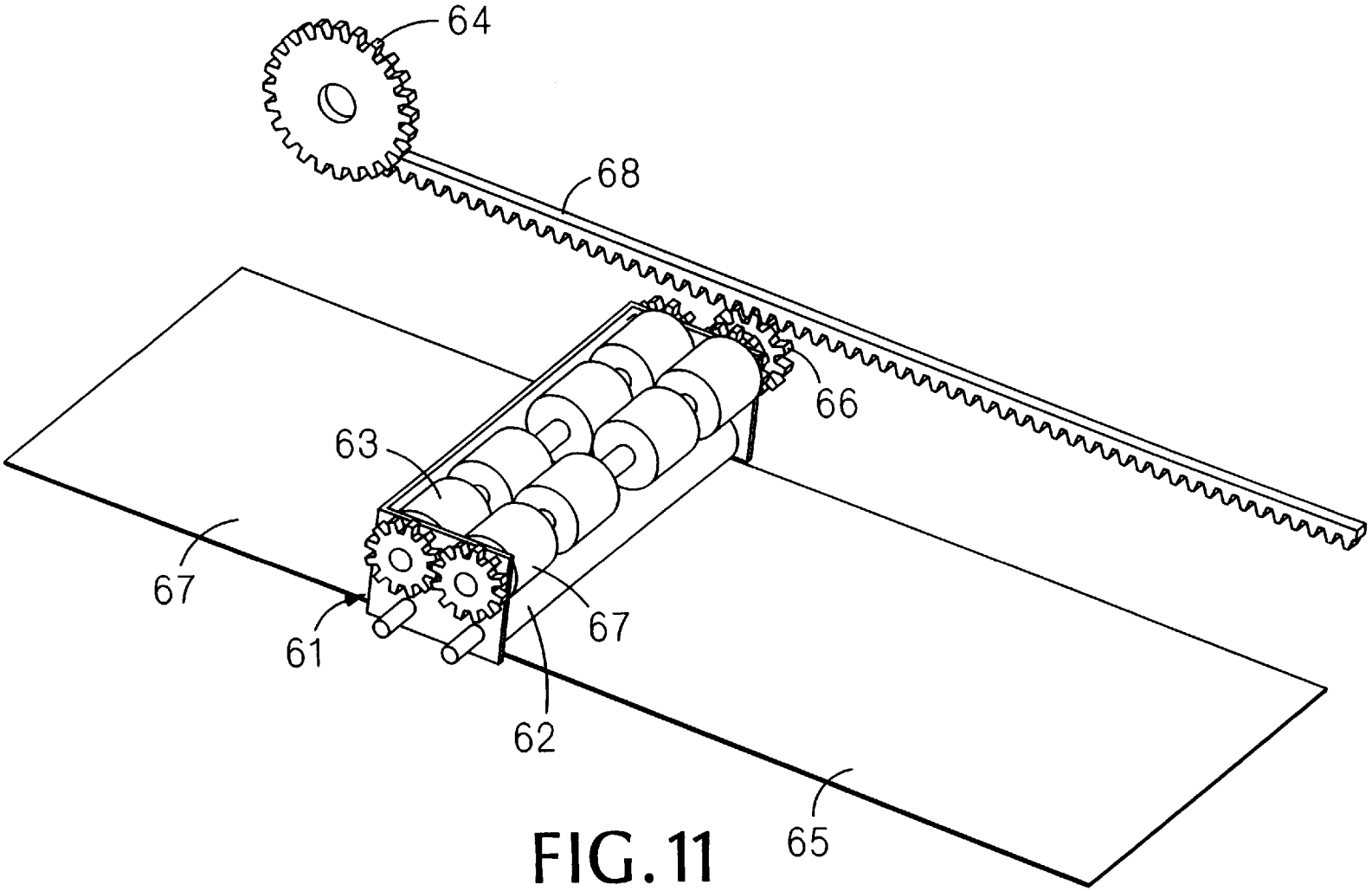
FIG. 11 shows the mechanism of FIG. 10 at the mid-cycle position.

FIG. 10 is a partially exploded, simplified depiction of another embodiment of a bill drive system 60 for a bill 40. The carriage 4 contains two nip rollers 63 and 67 for gripping the bill 40 between them. In this embodiment, one or both of the first and second nip rollers 63, 67 are under positive drive. The drive force can come either from a transfer gear 64 connected to the bill validator (not shown), or from the motion of the carriage 4 which acts upon a spur gear 66 engaged against a stationary rack 68 that is part of the side frame, or may come from a carriage motor implementation as described above. In the embodiment of FIG. 10, a one way clutch 69 embedded in the drivetrain ensures that the drive to the nip rollers 63, 67 is continuous even as the transfer gear 64 to the bill acceptor moves out of engagement with the carriage mounted gears. (See FIG. 11 which shows the mechanism of FIG. 10 at the mid-cycle position, when coil membranes 65 and 67 from hollow cylinders 61 and 62 are partially unrolled). By permitting the nip rollers 63, 67 to rotate independently of the carriage movement, the bill can thus be engaged in the carriage before the traverse motion begins. Another advantage is that the bill drive is performed by dedicated wheels on the nip rollers 63 and 67. The drive surfaces of these rollers thus may be selected only for their superior friction and wear characteristics.

In the case where multiple coil spring strips are used in parallel along the length of a hollow cylinder, a common membrane sheath (not shown) may be attached spanning the multiple adjacent spring strips and wrapped about them. Such a flexible membrane sheath would serve several purposes. First, the membrane sheath would control the position of the spring strips in relation to each other to avoid problems with overlaps that could otherwise occur. Second, the flexible membrane sheath prevents twisting of the spring strips due to small force imbalances that may occur. Lastly, the membrane sheath enables a surface with high friction properties to be presented to the bill. Alternately, two or more membrane sheaths could be used, each spanning two or more adjacent spring strips.

Figure 12:
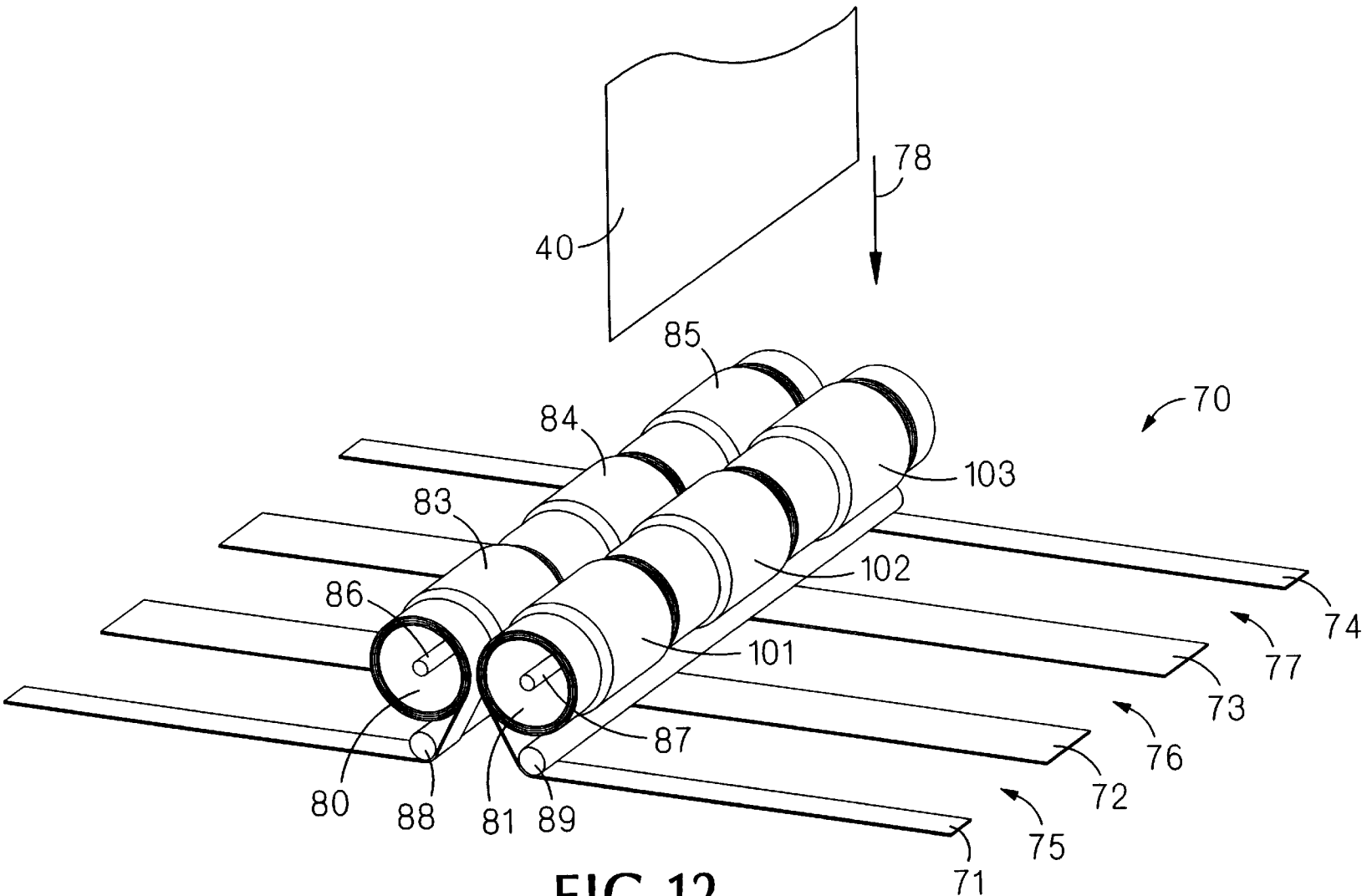
FIG. 12 shows another embodiment in which the stacking spring configuration includes a plurality of narrow bands.

FIG. 12 is another embodiment 70 of a stacking spring configuration. A plurality of narrow coil spring bands 71, 72, 73 and 74 are contained on hollow cylinders 80 and 81 on a carriage (not shown). In such a configuration, the coil spring bands may be formed of discrete strips as shown. Gaps 75, 76 and 77 between the strips are permitted consistent with spacings determined by the specific geometry of each of the items to be stacked. In the configuration of FIG. 12, bill 40 enters in a direction perpendicular to the stacking plane as indicated by the arrow 78. The bill is then gripped between one or more of the drive wheels 83, 84 and 85 of hollow cylinder 80 and opposing drive wheels 101, 102 and 103 of hollow cylinder 81 and pulled downwards as the carriage traverses. This configuration avoids the need for a diverter flap since the leading edge of the bill will naturally be folded in the correct direction onto the stack as the carriage moves.

In order to achieve positive drive, the hollow cylinder 80 is split into narrow strips punctuated by spaces for the drive wheels 83, 84 and 85, which are each attached to a drive shaft 86. The second hollow cylinder 81 may also contain a drive rod 87 for driving drive wheels 101, 102 and 103. The coil strips 71, 72, 73 and 74 in this embodiment are not in intimate contact with the bill at the hollow cylinder as the bill travels in the direction of arrow 78 since the outer diameter of the cylinder is less than the drive wheel diameter. The hollow cylinder, however, freely rotates on its shaft at a slightly higher rate ensuring that the surface velocities of the bill 40 and the soil strips are matched.

The embodiment of FIG. 12 also contains idler roller shafts 88 and 89, which are connected to the carriage and rotate freely. The idler roller shafts operate to smooth out the coil strips 71, 72, 73 and 74 as they unwrap from and roll up onto the hollow cylinders, and separate the moving drive wheels from the top of the stack as the carriage traverses to stack a bill.

Figure 13:
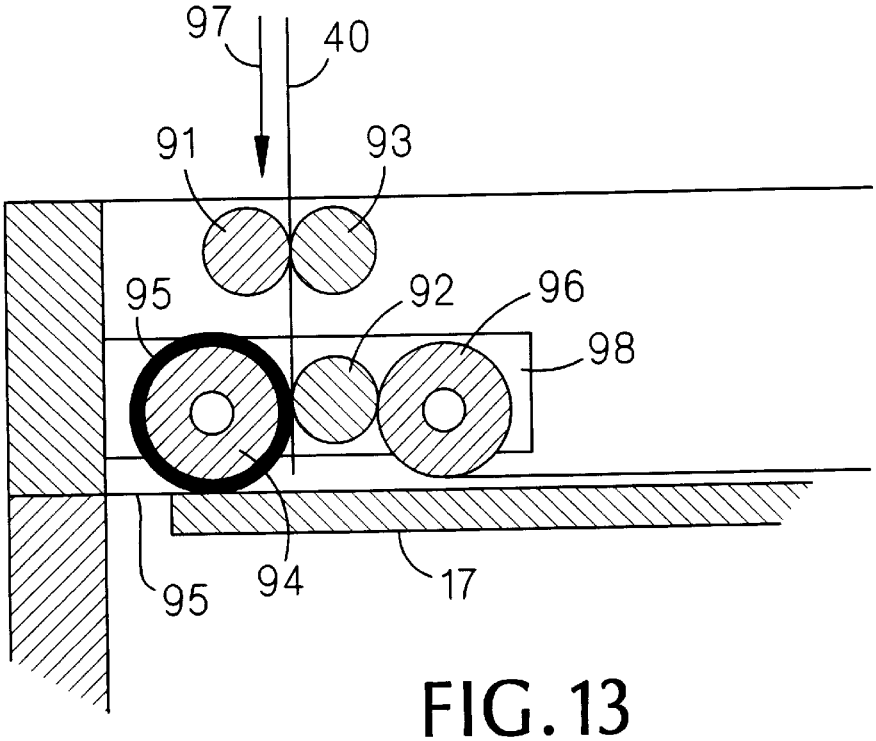
FIG. 13 shows an alternative implementation of a stacking mechanism according to the invention.
Figure 14:
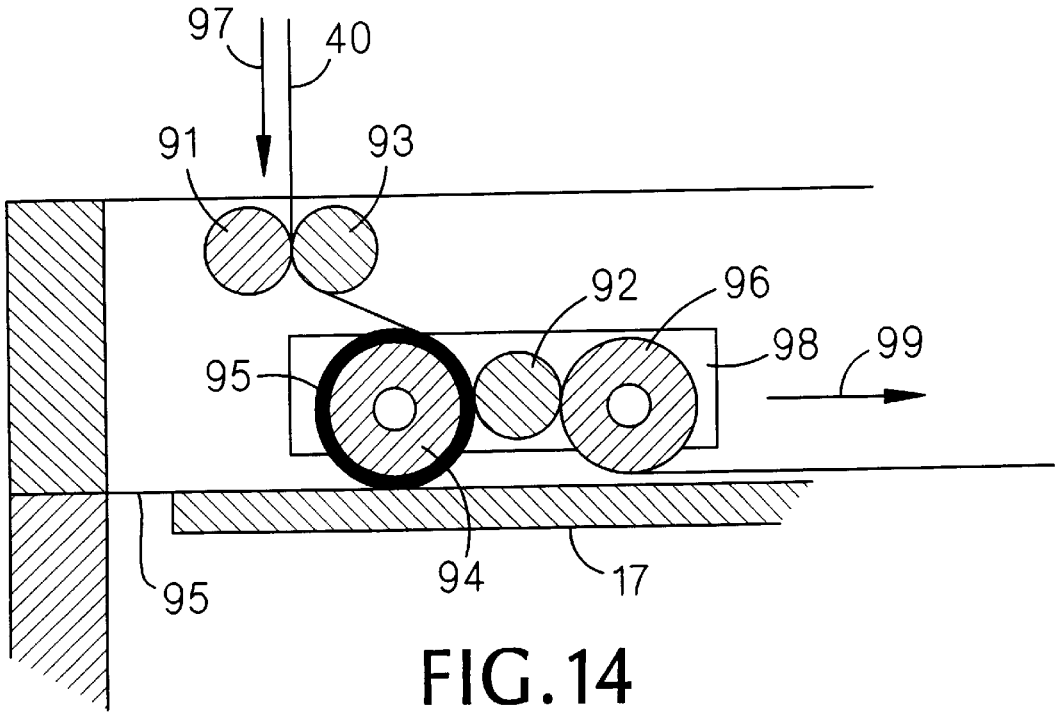
FIG. 14 shows the mechanism of FIG. 13 at its mid-cycle position.

FIGS. 13 and 14 illustrate a side view of another variant of a stacking mechanism 90. In these figures, a nip roller shaft 92 is in approximately the same plane as the first and second hollow cylinders 94, 96. Referring to FIG. 13, a bill 40 is introduced into the carriage means 98 in the direction of arrow 97 between two pinch rollers 91, 93. The bill 40 continues between the membrane 95 of the first hollow cylinder 94 and the nip roller 92. As the carriage means 98 moves from left to right in the direction of arrow 99 as shown in FIG. 14, the bill 40 is drawn downwards between the membrane 95 and the pressure plate 17. As discussed earlier, the carriage means 98 traverses the length of its track (not shown) to smoothly and dependably stack the bill 40 in a storage container. The carriage means 98 may be propelled by a separate actuator or by an integrated motor or motors, as explained above with regard to the carriage 4 and motorized carriage 140.

Figure 15:
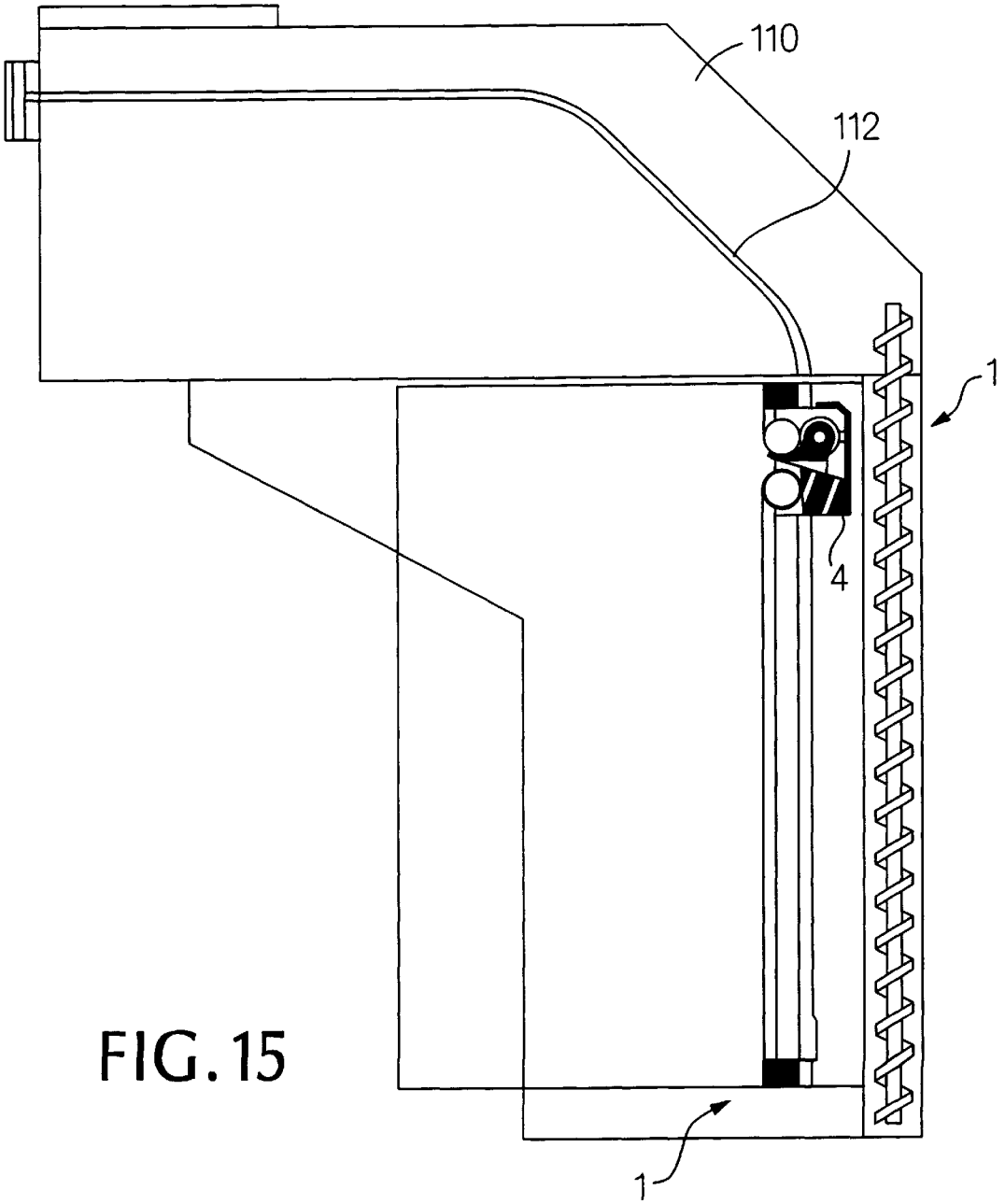
FIGS. 15, 16 and 17 illustrate some alternative configurations of a stacking mechanism according to the is invention attached to various media validators.
Figure 16:
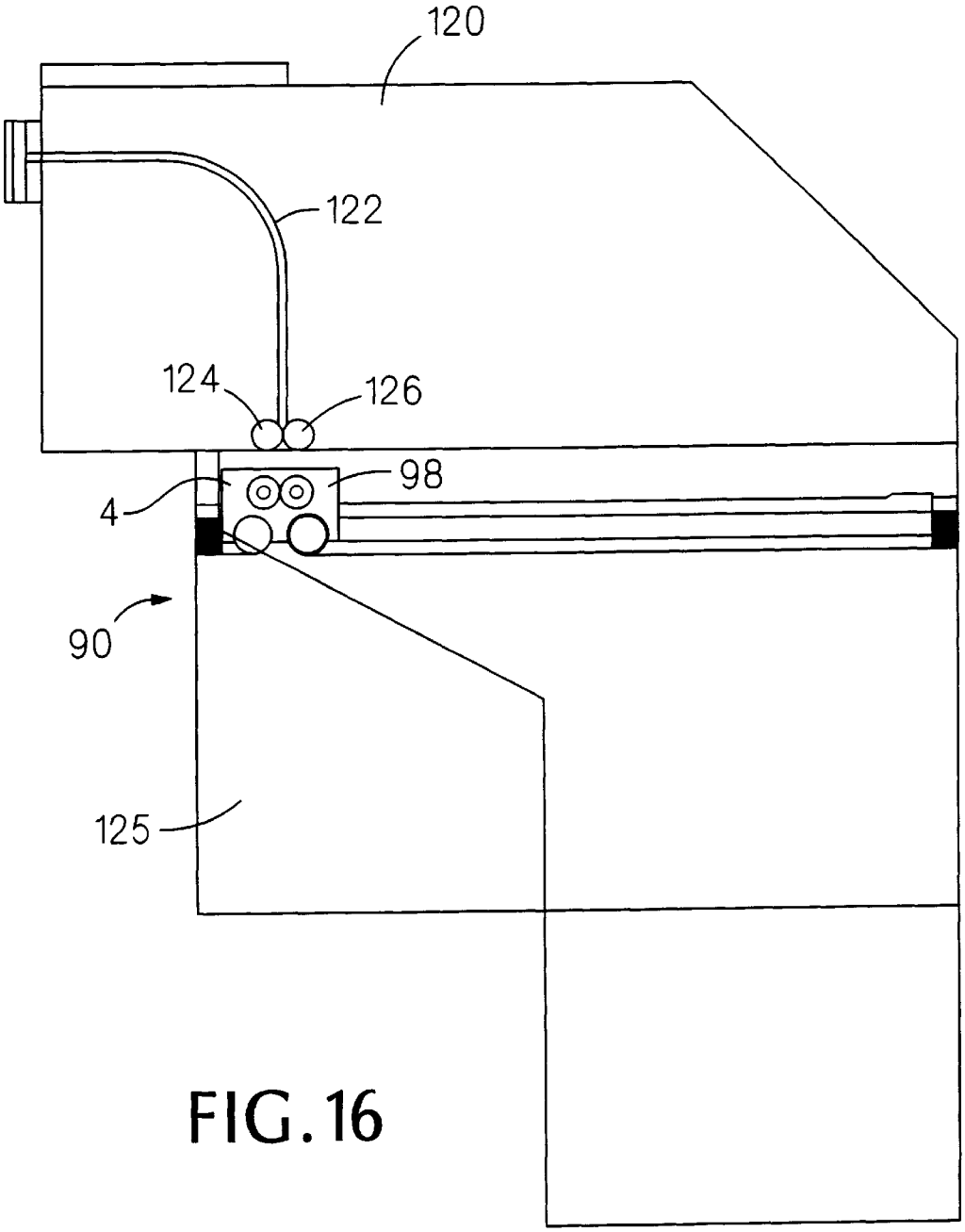
Figure 17:
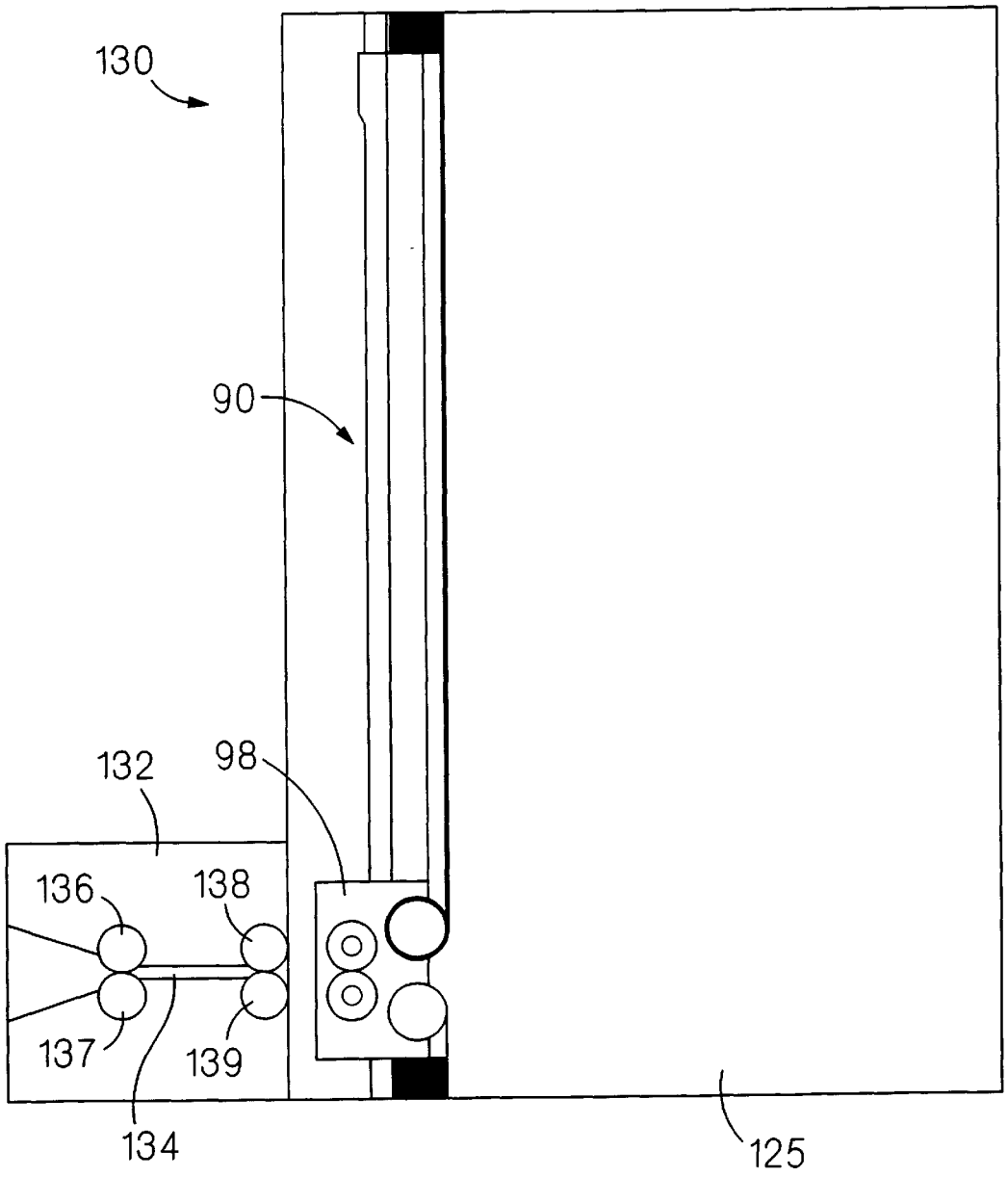

FIG. 15 illustrates a configuration in which a stacking mechanism 1 of FIG. 1 is integrated with a bill validator 110. A bill travels in a passageway 112 to the carriage 4 or 140 which operates as described above. FIG. 16 depicts a configuration of a stacking mechanism 90 of FIGS. 13 and 14 connected to a bill validator 120 having a bill passageway 122. A bill travels through the passageway 122 and is driven by drive rollers 124, 126 into the carriage means 98 and then stacked in a storage box 125. FIG. 17 shows another embodiment 130 of a stacking mechanism 90 connected to a compact validation unit 132 having a passageway 134. A bill is driven by rollers 136, 137 and/or 138, 139 into the carriage means 98 and then stacked in storage container 125.

Figure 18:
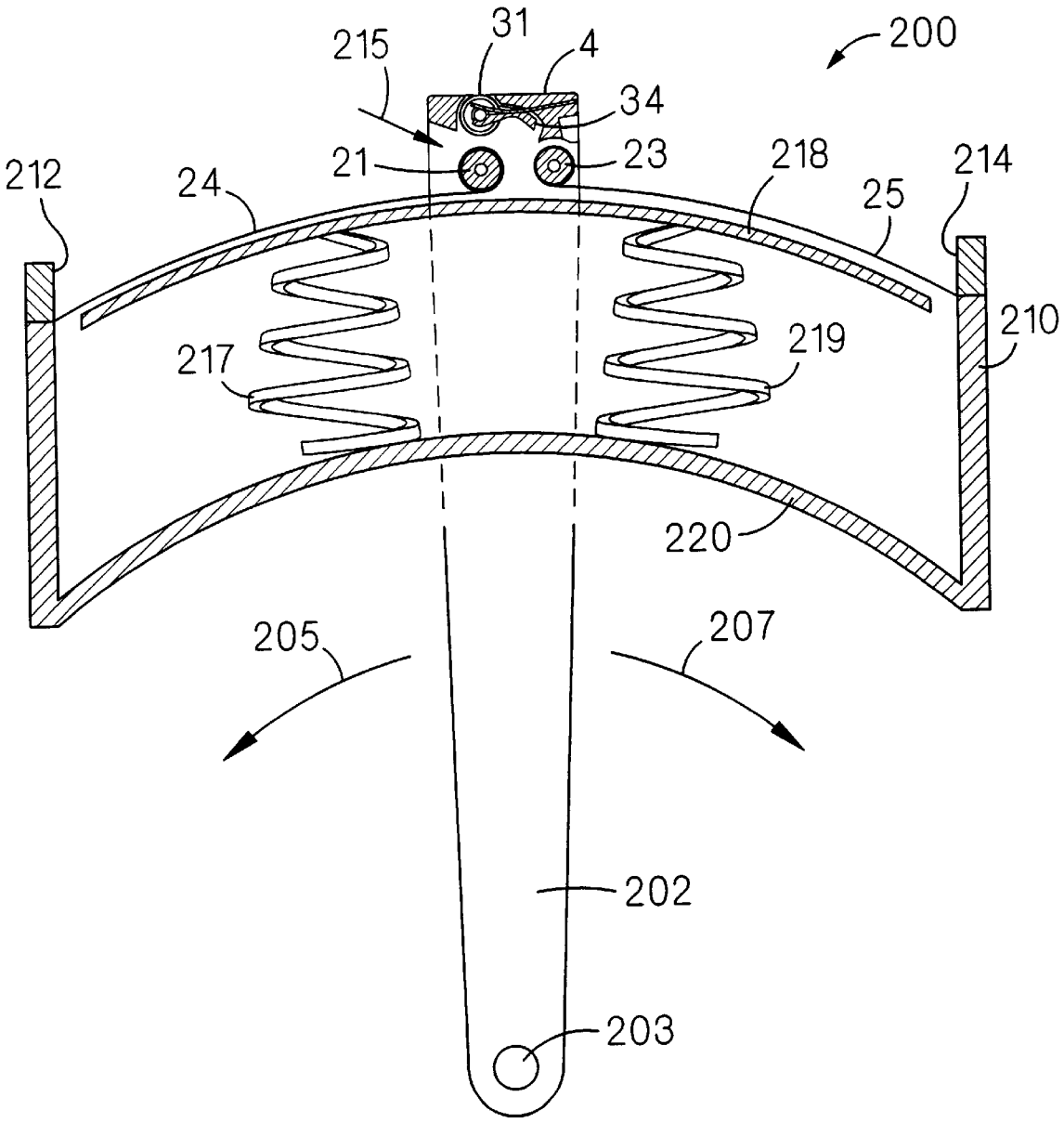
FIG. 18 is a cutaway side view of a curved path implementation of a stacking mechanism according to the invention.

FIG. 18 is a cutaway side view of a curved path stacking mechanism 200. In this implementation, a carriage 4 similar to the carriage described above travels in an arc of a circle, and is connected to at least one support leg 202. The support leg is driven by an actuator (not shown) to move about a pivot point 203 in the direction of arrows 205 and 207. A first end of a membrane 24 associated with rotating member 21 is connected to a front wall 212 of a container 210, and a first end of a membrane 25 associated with rotating member 23 is connected to a rear wall 214 of the container. As the support leg and carriage move in the direction of arrow 207, the membrane 24 is unwrapped from rotating member 21 and the membrane 25 is wrapped about rotating member 23. When the support leg and carriage move in the direction of arrow 205, the membrane 24 then wraps about the rotating member 21 as the membrane 25 unwraps from rotating member 23. When flexible media such as a banknote is to be stacked, the banknote enters the carriage in the direction of arrow 215. When the banknote reaches the rotating member 21, a nip roller 31 and a diverter 34 move into contact with the front portion of the banknote. The banknote is then gripped between the nip roller and the rotating member, and directed about the rotating member by the diverter. As the carriage moves in the direction of arrow 207, the leading edge of the banknote is pressed into contact between the membrane 24 and a pressure plate 218 and stacked, either on top of the pressure plate or on top of previously stacked flexible media. The stacking function may occur at any point along the carriage path, but in general the front edge of a banknote enters the carriage when the carriage is near the front wall 212. The position of the carriage on the path when flexible media is to be stacked, and the operation of the nip roller and diverter may be controlled by a microprocessor or mechanical mechanism or some other control device.

In the implementation of FIG. 18, the top surface of pressure plate 218 is convex in shape and thus provides a convex stacking surface for the flexible media. The pressure plate also exerts a force on the membranes 24 and 25, being biased by two springs 217 and 219 which are also connected to a convex rear wall 220. However, it should be understood that one, or more than two, biasing means could be used to support the pressure plate, and that the rear wall 220 need not be convex shaped. The configuration as shown advantageously stacks long banknotes and other flexible media in a shorter space and provides for a simplified carriage design.

It should be understood that the convex arc shape of the pressure plate and carriage path shown in FIG. 18 could be concave shaped instead. Further, the carriage path may be of some other curved shape, such as a portion of a parabola, wherein the pressure plate would be of a complementary shape. In addition, another type of movement means could be substituted for the support leg to drive the carriage on its path.

A number of embodiments of the present invention have been described. Nevertheless, it should be understood that various modifications may be made without departing from the spirit and scope of the invention. Accordingly, other embodiments are within the scope of the following claims.

What is claimed is:

1. An apparatus capable of storing flexible media of a plurality of dimensions, comprising:

a carriage having at least two rotating members;

a membrane wrapped about each of the rotating members;

a frame for supporting the membranes; and at least one actuator for causing a first membrane to unwrap and a second membrane to wrap about their respective rotating members as the carriage moves.

2. The apparatus of claim 1, further comprising a container connected to the frame.

3. The apparatus of claim 2, further comprising a pressure plate connected to the container, wherein the pressure plate exerts a force against the unwrapped portion of the membranes.

4. The apparatus of claim 3, further comprising biasing means connected to the pressure plate to distribute the force.

5. The apparatus of claim 1, further comprising a diverter connected to the carriage to guide the flexible media.

6. The apparatus of claim 1, further comprising a nip roller connected to the carriage for gripping the flexible media.

7. The apparatus of claim 6, further comprising an elastic element to bias the nip roller into a gripping position.

8. The apparatus of claim 6, further comprising a ramp and cam mechanism to bias the nip roller into a gripping position.

9. The apparatus of claim 8, wherein the ramp and cam mechanism biases a diverter into a position to guide the flexible media.

10. The apparatus of claim 1, wherein at least one actuator is coupled to at least one rotating member.

11. The apparatus of claim 1, wherein at least one actuator is coupled to the carriage.

12. The apparatus of claim 1, further comprising a bill validator for transporting bills to the carriage.

13. The apparatus of claim 1, further comprising at least one additional actuator.

14. The apparatus of claim 13, wherein at least one additional actuator moves a diverter that is connected to the carriage.

15. The apparatus of claim 13, wherein at least one additional actuator moves a nip roller that is connected to the carriage.

16. The apparatus of claim 1, wherein at least one rotating member comprises a rotatable shaft mounted in the frame and an intermediate element mounted in the carriage for supporting the membrane.

17. The apparatus of claim 1, wherein the membranes are spring coils.

18. The apparatus of claim 1, wherein the membranes comprise a plurality of strips.

19. The apparatus of claim 18, further comprising a sheath for controlling the strips.

20. The apparatus of claim 1, further comprising at least one torsional elastic element for supplying a tension to at least one of the membranes.

21. A method for a stacker apparatus capable of stacking flexible media of varying dimensions in any of a plurality of orientations, comprising:

transporting the flexible media to a carriage;

translating the carriage to unwrap a first membrane from a first rotating member and to fold the leading edge of the media onto a stack;

wrapping a second membrane about a second rotating member of the carriage;

gripping the media between the first membrane and the stack as the carriage moves to stack the media;

translating the carriage in the opposite direction after the media has been stacked; and gripping the media between the second membrane and the stack as the second membrane unwraps from the second rotating member.

22. The method of claim 21, wherein a plurality of sheets of flexible media are stacked during a stacking cycle.

23. The method of claim 21, wherein the carriage moves in a linear path to stack flexible media.

24. An apparatus capable of stacking flexible media of a plurality of dimensions, comprising:

a container for storing the flexible media;

a carriage movably mounted on the container, the carriage having at least two rotating members; and a membrane wrapped about each of the rotating members.

25. The apparatus of claim 24, further comprising at least one actuator for driving the carriage.

26. The apparatus of claim 25, wherein at least one actuator is coupled to at least one of the rotating members.

27. The apparatus of claim 25, wherein at least one actuator is coupled to the carriage.

28. The apparatus of claim 24, further comprising a pressure plate attached to the container for exerting a force against the unwrapped portion of the membranes.

29. The apparatus of claim 25, further comprising biasing means connected to the pressure plate to distribute the force.

30. The apparatus of claim 24, wherein the carriage includes a nip roller for gripping the flexible media as it is inserted.

31. The apparatus of claim 24, wherein the carriage includes a diverter for guiding the flexible media.

32. The apparatus of claim 24, further comprising a bill validator for transporting bills to the carriage.

33. The apparatus of claim 24, wherein at least one rotating member comprises a rotatable shaft and an intermediate element for supporting the membrane.

* * * * *